US010563551B2

(12) United States Patent
Son et al.

(10) Patent No.: US 10,563,551 B2
(45) Date of Patent: Feb. 18, 2020

(54) CONTINUOUS VARIABLE VALVE DURATION APPARATUS AND ENGINE PROVIDED WITH THE SAME

(71) Applicants: Hyundai Motor Company, Seoul (KR); Kia Motors Corporation, Seoul (KR)

(72) Inventors: You Sang Son, Suwon-si (KR); Ingee Suh, Yongin-si (KR); Kiyoung Kwon, Yongin-si (KR); In Sang Ryu, Incheon (KR); Kyoung Pyo Ha, Seongnam-si (KR); Dongheon Park, Seongnam-si (KR); Wootae Kim, Anyang-si (KR); Back Sik Kim, Osan-si (KR); Seung Jae Lee, Bucheon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 220 days.

(21) Appl. No.: 15/806,534

(22) Filed: Nov. 8, 2017

(65) Prior Publication Data

US 2018/0163582 A1 Jun. 14, 2018

(30) Foreign Application Priority Data

Dec. 14, 2016 (KR) ..... 10-2016-0170391

(51) Int. Cl.
*F01L 1/34* (2006.01)
*F01L 13/00* (2006.01)
(Continued)

(52) U.S. Cl.
CPC ..... *F01L 13/0015* (2013.01); *F01L 1/047* (2013.01); *F01L 1/267* (2013.01); *F01L 1/356* (2013.01);
(Continued)

(58) Field of Classification Search
CPC ..... F01L 13/0015; F01L 1/047; F01L 1/267; F01L 1/356; F01L 2001/0473; F01L 2013/0084
See application file for complete search history.

(56) References Cited

U.S. PATENT DOCUMENTS

| | | | |
|---|---|---|---|
| 5,924,334 | A | 7/1999 | Hara et al. |
| 6,382,149 | B1 | 5/2002 | Fischer et al. |
| 2016/0169066 | A1 | 6/2016 | Son et al. |

FOREIGN PATENT DOCUMENTS

| | | | |
|---|---|---|---|
| EP | 0 032 056 | A1 | 7/1981 |
| EP | 2 322 771 | A1 | 5/2011 |

(Continued)

OTHER PUBLICATIONS

European Search Report dated May 22, 2018 in European Patent Application No. 17200078.8.

*Primary Examiner* — Zelalem Eshete
(74) *Attorney, Agent, or Firm* — Morgan, Lewis & Bockius LLP

(57) ABSTRACT

A continuous variable valve duration apparatus may include a camshaft, a cam unit on which a cam is formed, of which the camshaft is inserted thereto and of which a relative phase angle with respect to the camshaft is variable, an inner bracket transmitting rotation of the camshaft to the cam unit, a wheel housing in which the inner bracket is rotatably inserted, on which a guide groove parallel to the camshaft is formed, and on which a guide hole vertical to the camshaft is formed, a guide portion including a guide shaft inserted into the guide hole for guiding movement of the wheel housing and a control portion including a control shaft disposed parallel to the camshaft and inserted into the guide groove, and the control portion selectively rotating the control shaft for the relative position of the wheel housing with respect to the camshaft to be changed.

18 Claims, 19 Drawing Sheets

(51) Int. Cl.
*F01L 1/356* (2006.01)
*F01L 1/26* (2006.01)
*F01L 1/047* (2006.01)

(52) U.S. Cl.
CPC ..... *F01L 2001/0473* (2013.01); *F01L 2013/0084* (2013.01)

(56) References Cited

FOREIGN PATENT DOCUMENTS

| | | | |
|---|---|---|---|
| GB | 2 267 949 | A | 12/1993 |
| JP | 4259512 | B2 | 4/2009 |
| JP | 2016-109120 | A | 6/2016 |
| KR | 10-1684559 | B1 | 12/2016 |

CONTINUOUS VARIABLE VALVE DURATION APPARATUS AND ENGINE PROVIDED WITH THE SAME

CROSS-REFERENCE TO RELATED APPLICATION

The present application claims priority to Korean Patent Application No. 10-2016-0170391 filed on Dec. 14, 2016, the entire contents of which are incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus and an engine provided with the same which may vary the opening duration of a valve according to the operation conditions of an engine utilizing a simple construction.

Description of Related Art

An internal combustion engine generates power by burning fuel in a combustion chamber with air drawn into the chamber. Intake valves are operated by a camshaft to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening and closing timing of the valves depends on the rotation speed of the engine. To achieve optimal valve operation depending on the rotation speed of the engine, various research, such as designing of a plurality of cams and a continuous variable valve lift (CVVL) that can change valve lift according to engine speed, have been undertaken.

To achieve optimal valve operation dependent on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve duration apparatus and an engine provided with the same which may vary the opening duration of a valve according to the operation conditions of an engine, utilizing a simple construction.

A continuous variable valve duration apparatus according to an exemplary embodiment of the present invention may include a camshaft, a cam device on which a cam is formed, of which the camshaft is inserted thereto and of which a relative phase angle with respect to the camshaft is variable, an internal bracket transmitting rotation of the camshaft to the cam device, a wheel housing in which the internal bracket is rotatably inserted on which a guide groove parallel to the camshaft is formed, and on which a guide hole vertical to the camshaft is formed, a guide portion including a guide shaft inserted into the guide hole for guiding the movement of the wheel housing, and a control portion including a control shaft disposed parallel to the camshaft and inserted into the guide groove. The control portion selectively rotates the control shaft for the relative position of the wheel housing with respect to the camshaft to be changed.

The guide portion may further include a guide bracket which supports the guide shaft.

A first sliding hole and a second sliding hole may be formed on the internal bracket respectively and a cam slot may be formed at the cam device. The continuous variable valve duration apparatus may further include a slider pin connected to the camshaft and rotatably inserted into the first sliding hole and a roller cam slidably inserted into the cam slot and rotatably inserted into the second sliding hole.

The roller cam may include a roller cam body slidably inserted into the cam slot, and a cam head rotatably inserted into the second sliding hole. A protrusion for preventing the roller cam from being separated may be formed on the roller cam.

The slider pin may include a pin body slidably inserted into the camshaft and a pin head rotatably inserted into the first sliding hole.

The pin body and the pin head may be integrally formed.

A camshaft oil hole may be formed within the camshaft along a longitudinal direction thereof, a body oil hole communicating with the camshaft oil hole may be formed at the pin body of the slider pin, and an oil groove communicating with the body oil hole may be formed at the pin head of the slider pin.

The cam device may include a first cam portion and a second cam portion which are disposed corresponding to a cylinder and a neighboring cylinder respectively, and the internal bracket may include a first internal bracket and a second internal bracket transmitting the rotation of the camshaft to the first cam portion and the second cam portion respectively.

The continuous variable valve duration apparatus may further include a bearing disposed within the wheel housing for supporting the first internal bracket and the second internal bracket.

The first internal bracket and the second internal bracket may be connected to each other.

Two cams may be formed at the first cam portion and the second cam portion and a cam connecting portion may be formed between the cams. The continuous variable valve duration apparatus may further include a cam cap on which a cam supporting portion supporting the cam connecting portion is formed.

The control portion may include a control motor, a first journal connected to the control motor and on which a first journal hole is eccentrically formed, and a second journal on which a second journal hole is eccentrically formed. The control shaft may be inserted into the first journal hole and the second journal hole.

The continuous variable valve duration apparatus may further include a journal bracket rotatably supporting the first journal and the second journal.

A stopper may be formed at the control portion for limiting rotation of the control shaft.

The continuous variable valve duration apparatus may further include a cam cap rotatably supporting the cam device, and a guide bracket supporting the guide shaft and connected to the cam cap.

The continuous variable valve duration apparatus may further include a first journal on which a first journal hole where the control shaft is inserted into is eccentrically formed, a second journal on which a second journal hole where the control shaft is inserted into is eccentrically formed, and a journal bracket rotatably supporting the first journal and the second journal.

The journal bracket may be mounted to the cam cap.

An engine according to an exemplary embodiment of the present invention may be provided with the continuous variable valve duration apparatus.

As described above, a continuous variable valve duration apparatus according to an exemplary embodiment of the present invention may vary an opening duration of a valve according to operation conditions of an engine, utilizing a simple construction.

The continuous variable valve duration apparatus according to an exemplary embodiment of the present invention may be reduced in size and thus an entire height of a valve train may be reduced.

Since the continuous variable valve duration apparatus may be applied to a conventional engine without excessive modification, productivity may be enhanced and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
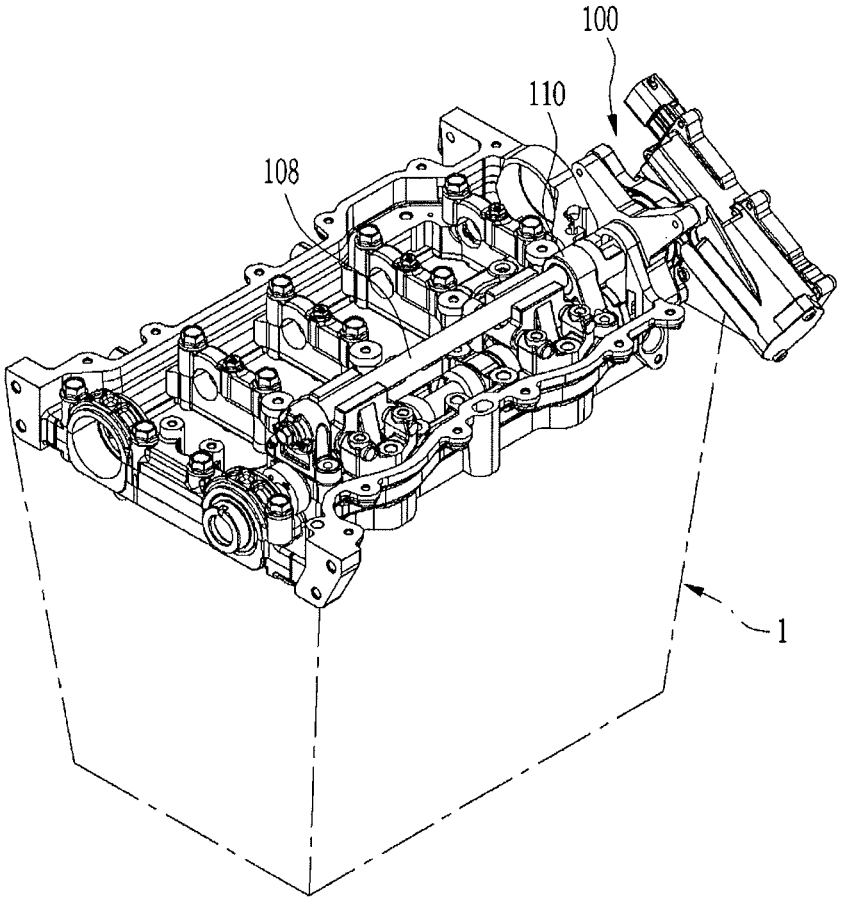
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A part irrelevant to the description will be omitted to clearly describe the present invention, and the same or similar elements will be designated by the same reference numerals throughout the specification.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
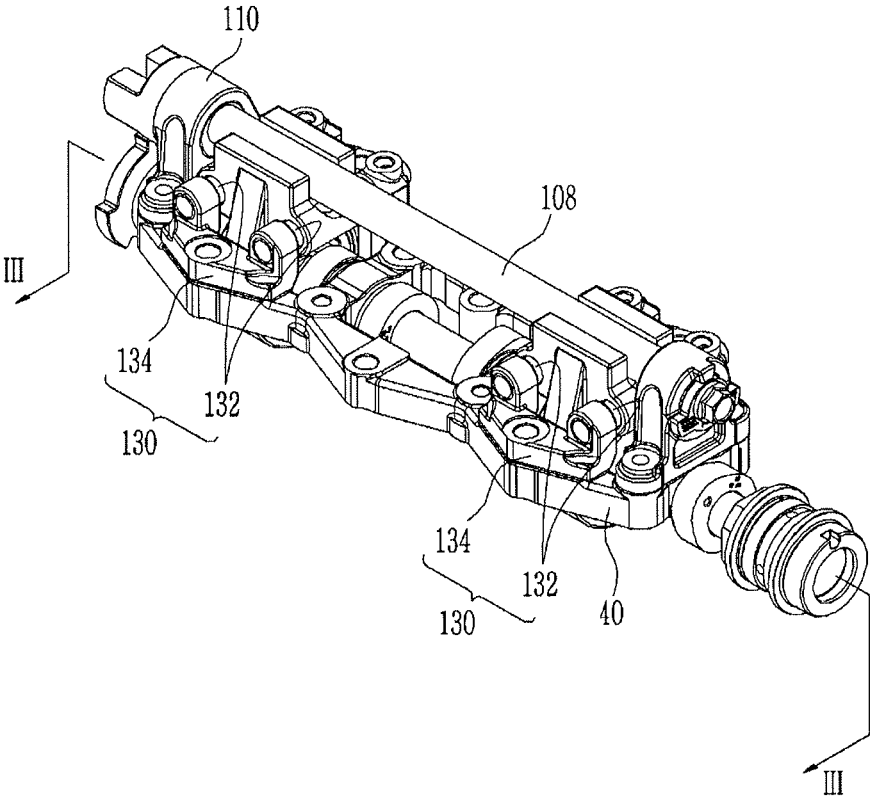
FIG. 2 is a perspective view of a continuous variable valve duration apparatus according to an exemplary embodiment of the present invention.

FIG. 1 is a perspective view of an engine provided with a continuous variable valve duration apparatus according to an exemplary embodiment of the present invention, and FIG. 2 is a perspective view of a continuous variable valve duration apparatus according to an exemplary embodiment of the present invention.

Figure 3:
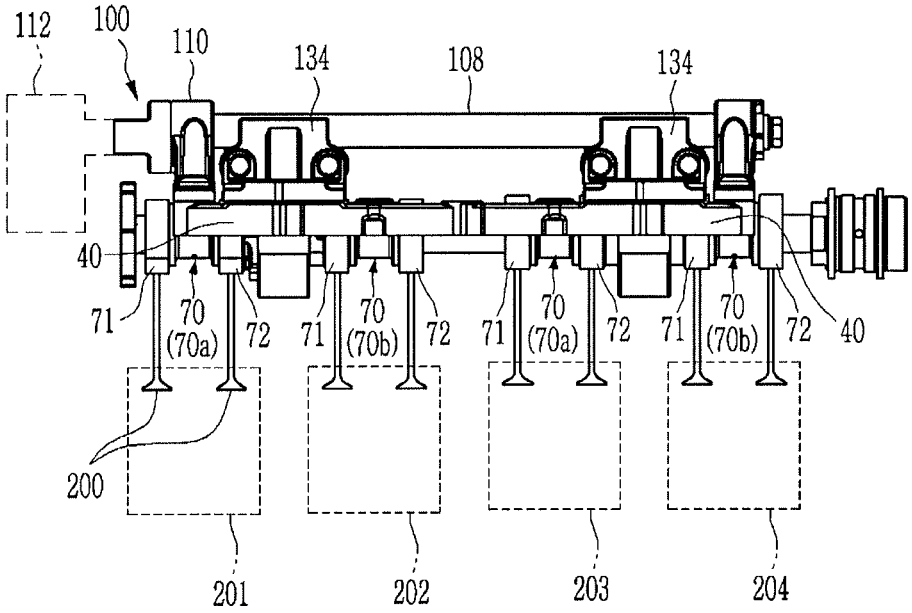
FIG. 3 is a cross-sectional view along line III-III of FIG. 2.
Figure 4:
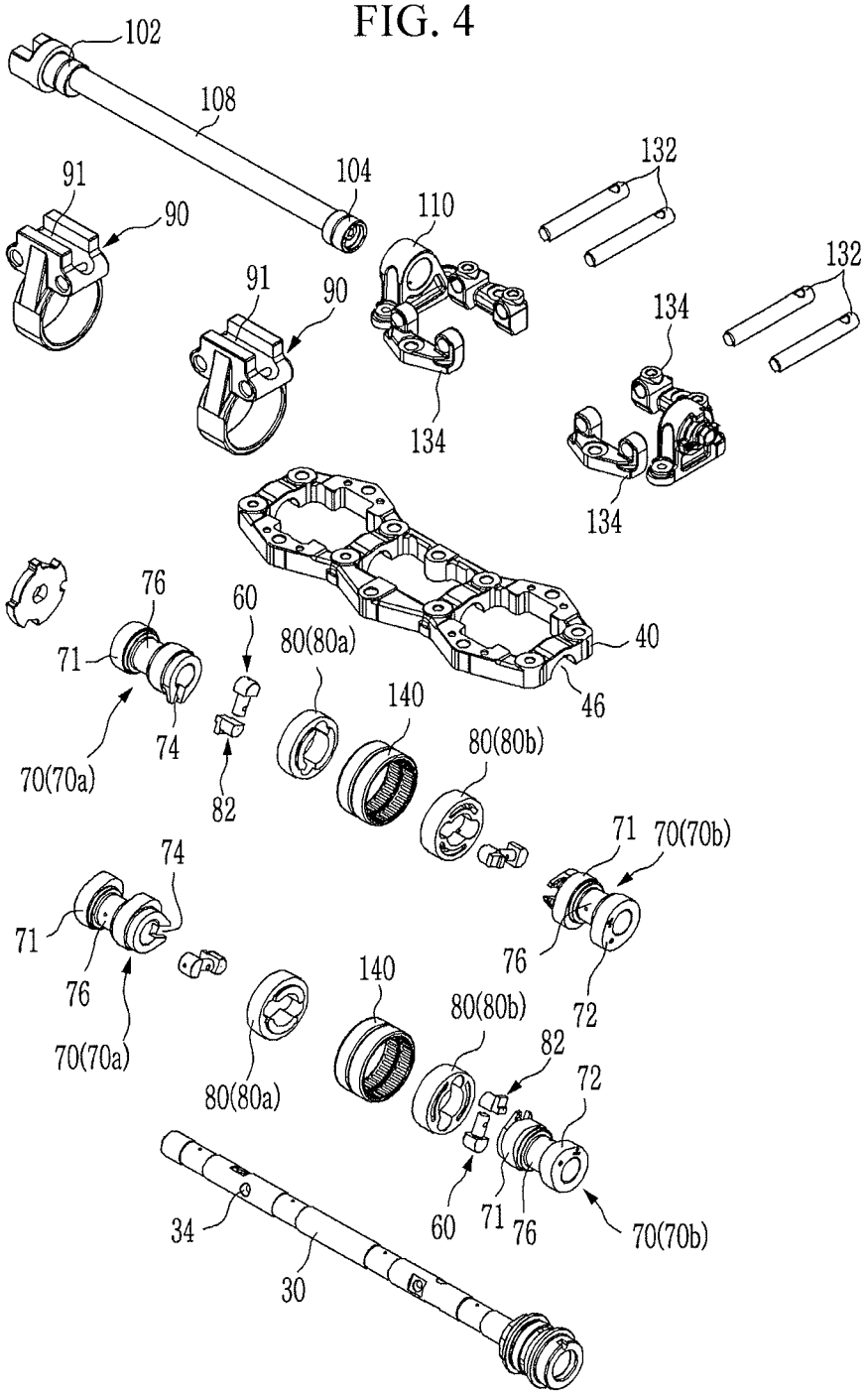
FIG. 4 is an exploded perspective view of a continuous variable valve duration apparatus according to an exemplary embodiment of the present invention.

FIG. 3 is a cross-sectional view along line III-III of FIG. 2, and FIG. 4 is an exploded perspective view of a continuous variable valve duration apparatus according to an exemplary embodiment of the present invention.

Referring to FIG. 1, FIG. 2, FIG. 3, and FIG. 4, an engine 1 according to an exemplary embodiment of the present invention includes a continuous variable valve duration apparatus mounted to a cylinder head.

In the drawing, 4 cylinders 201, 202, 203, and 204 are formed at the engine, but it is not limited thereto.

The continuous variable valve duration apparatus according to an exemplary embodiment of the present invention may include a camshaft 30, a cam device 70 on which a cam 71 is formed, of which the camshaft 30 is inserted thereto and of which a relative phase angle with respect to the camshaft 30 is variable, an internal bracket 80 transmitting the rotation of the camshaft 30 to the cam device 70, a wheel housing 90 in which the internal bracket 80 is rotatably inserted, on which a guide groove 91 parallel to the camshaft 30 is formed, and on which a guide hole 95 vertical to the camshaft 30 is formed, a guide portion 130 including a guide shaft 132 inserted into the guide hole 95 for guiding movement of the wheel housing 90 and a control portion 100 including a control shaft 108 disposed parallel to the camshaft 30 and inserted into the guide groove 91, and the control portion 100 selectively rotating the control shaft 108 for the relative position of the wheel housing 90 with respect to the camshaft 30 to be changed.

The guide portion 130 further includes a guide bracket 134 supporting the guide shaft 132.

The camshaft 30 may be an intake camshaft or an exhaust camshaft.

Figure 5:
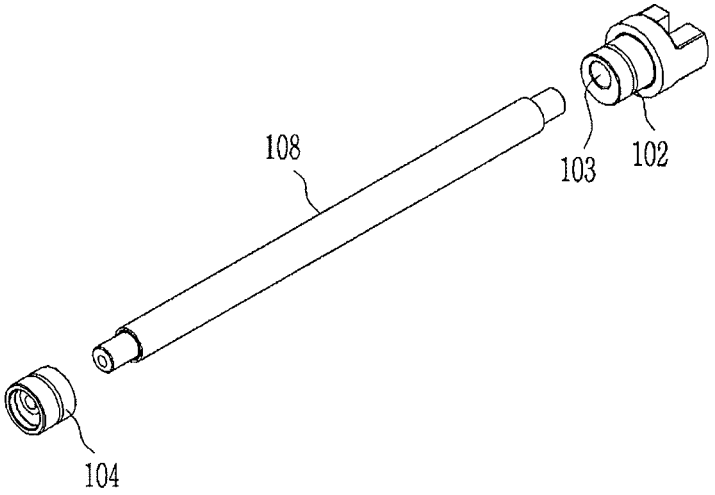
FIG. 5 is an exploded perspective view of a control shaft, a first journal and a second journal of a continuous variable valve duration apparatus according to an exemplary embodiment of the present invention.
Figure 6:
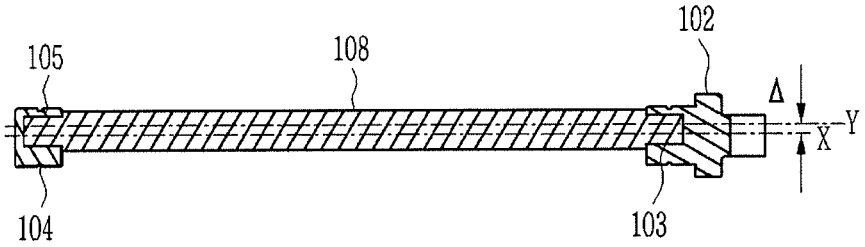
FIG. 6 is a cross-sectional view of a control shaft, a first journal and a second journal of a continuous variable valve duration apparatus according to an exemplary embodiment of the present invention.

FIG. 5 is an exploded perspective view of a control shaft, a first journal, and a second journal of a continuous variable valve duration apparatus according to an exemplary embodiment of the present invention, and FIG. 6 is a cross-sectional view of a control shaft, a first journal and a second journal of a continuous variable valve duration apparatus according to an exemplary embodiment of the present invention.

Referring to FIG. 1 to FIG. 6, the control portion 100 includes a control motor 112, a first journal 102 connected to the control motor 112 on which a first journal hole 103 is eccentrically formed, and a second journal 104 on which a second journal hole 105 is eccentrically formed. The control shaft 108 is inserted into the first journal hole 103 and the second journal hole 104.

A journal bracket 110 rotatably supporting the first journal 102 and the second journal 104 is disposed.

As shown in FIG. 5 and FIG. 6, the first journal hole 103 and the second journal hole 105 are eccentrically formed, and a center line Y of the control shaft 108 is offset by Δ from a rotation center X of the first journal 102 and the second journal 104.

Since the first journal hole 103 and the second journal hole 105 are eccentrically formed at the first journal 102 and the second journal 104 respectively, the control shaft 108 is simply assembled thus manufacturing process may be simplified and manufacturing cost may be reduced.

Figure 7:
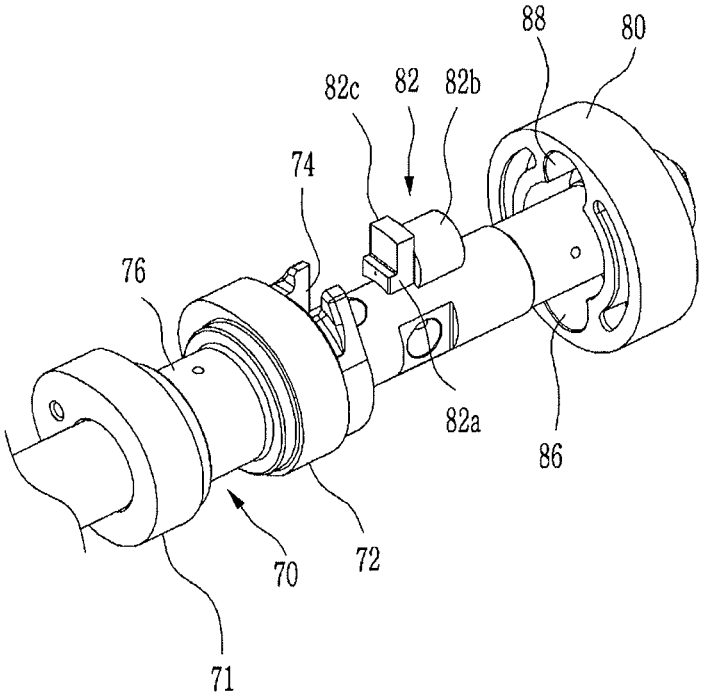
FIG. 7 is an exploded perspective view of an internal bracket and a cam device of a continuous variable valve duration apparatus according to an exemplary embodiment of the present invention.
Figure 8:
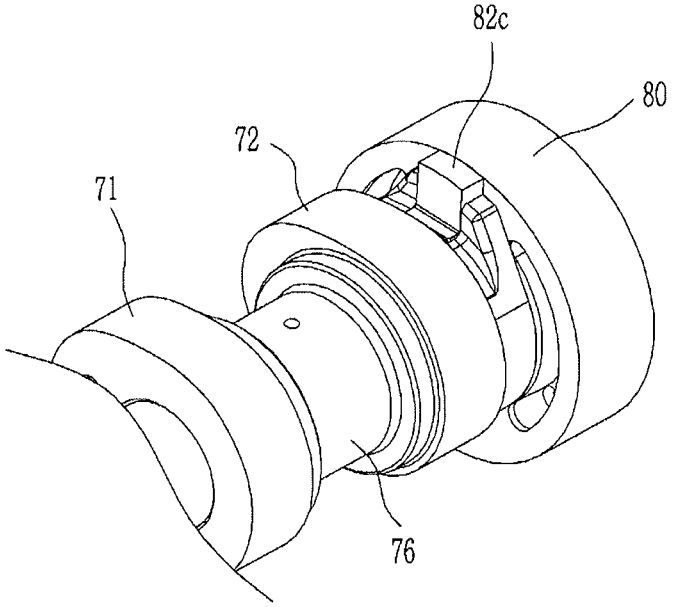
FIG. 8 is a perspective view of an internal bracket and a cam device of a continuous variable valve duration apparatus according to an exemplary embodiment of the present invention.

FIG. 7 is an exploded perspective view of an internal bracket and a cam device of a continuous variable valve duration apparatus according to an exemplary embodiment of the present invention, and FIG. 8 is a perspective view of an internal bracket and a cam device of a continuous variable valve duration apparatus according to an exemplary embodiment of the present invention.

Figure 9:
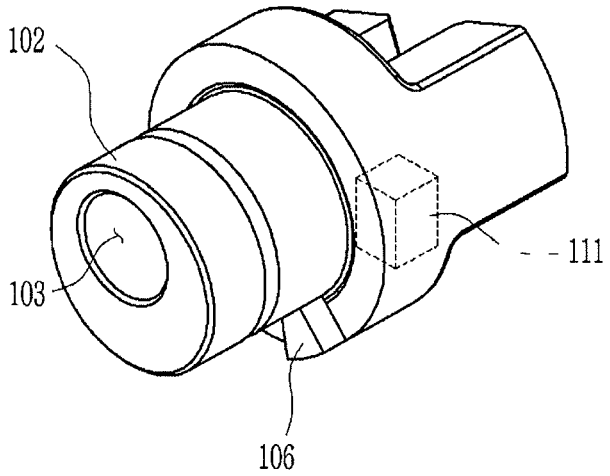
FIG. 9 is a perspective view of a first journal of a continuous variable valve duration apparatus according to an exemplary embodiment of the present invention.
Figure 10:
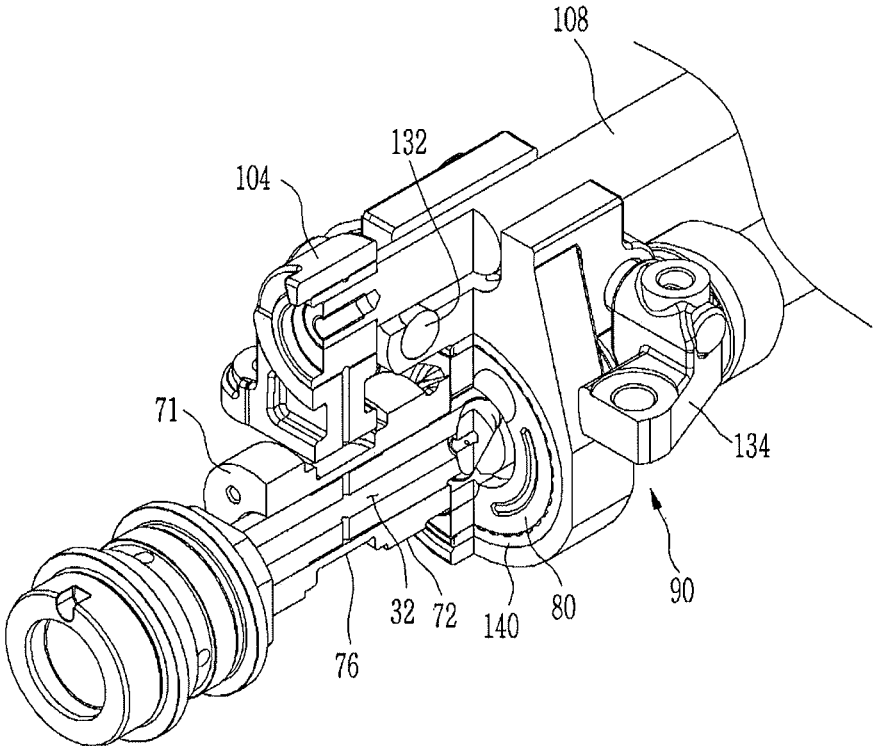
FIG. 10 is a partial cross-sectional view of a continuous variable valve duration apparatus according to an exemplary embodiment of the present invention.

FIG. 9 is a perspective view of a first journal of a continuous variable valve duration apparatus according to an exemplary embodiment of the present invention, and FIG. 10 is a partial cross-sectional view of a continuous variable valve duration apparatus according to an exemplary embodiment of the present invention.

Figure 11:
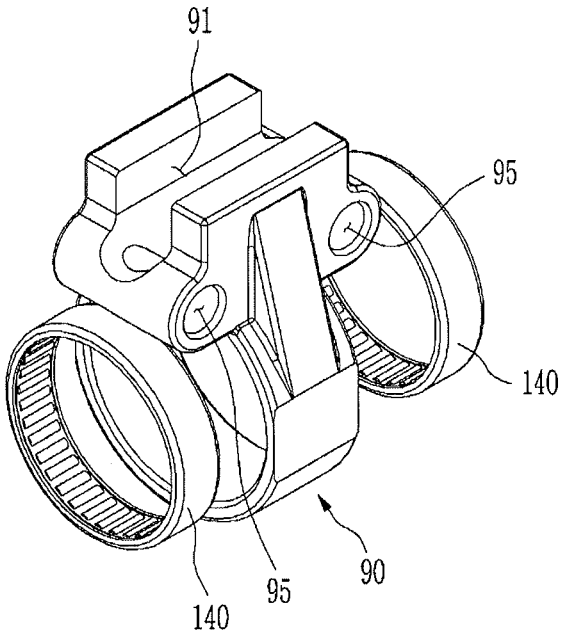
FIG. 11 is a perspective view of a wheel housing of a continuous variable valve duration apparatus according to an exemplary embodiment of the present invention.
Figure 12:
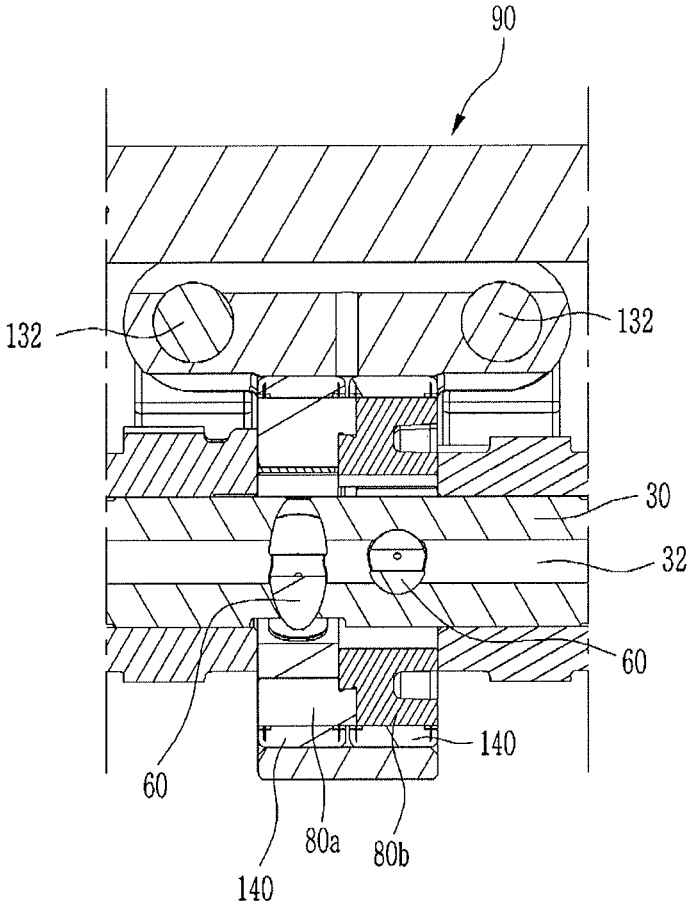
FIG. 12 is a cross-sectional view of a guide portion and an internal bracket of a continuous variable valve duration apparatus according to an exemplary embodiment of the present invention.

FIG. 11 is a perspective view of a wheel housing of a continuous variable valve duration apparatus according to an exemplary embodiment of the present invention, and FIG. 12 is a cross-sectional view of a guide portion and an internal bracket of a continuous variable valve duration apparatus according to an exemplary embodiment of the present invention.

Figure 13:
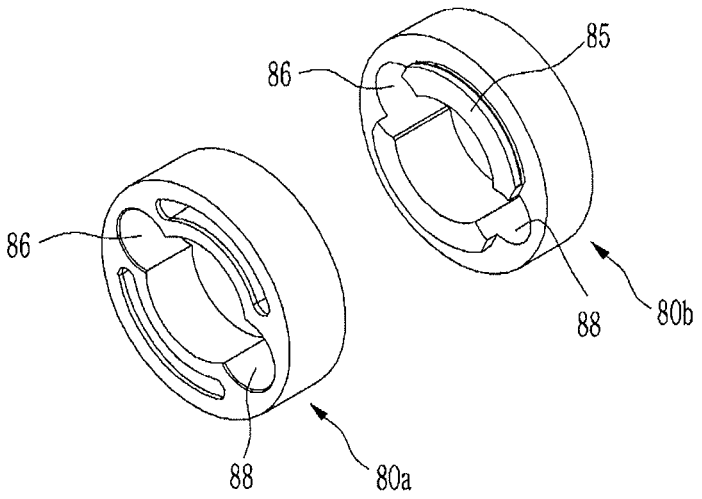
FIG. 13 is an exploded perspective view of and an internal bracket of a continuous variable valve duration apparatus according to an exemplary embodiment of the present invention.
Figure 14:
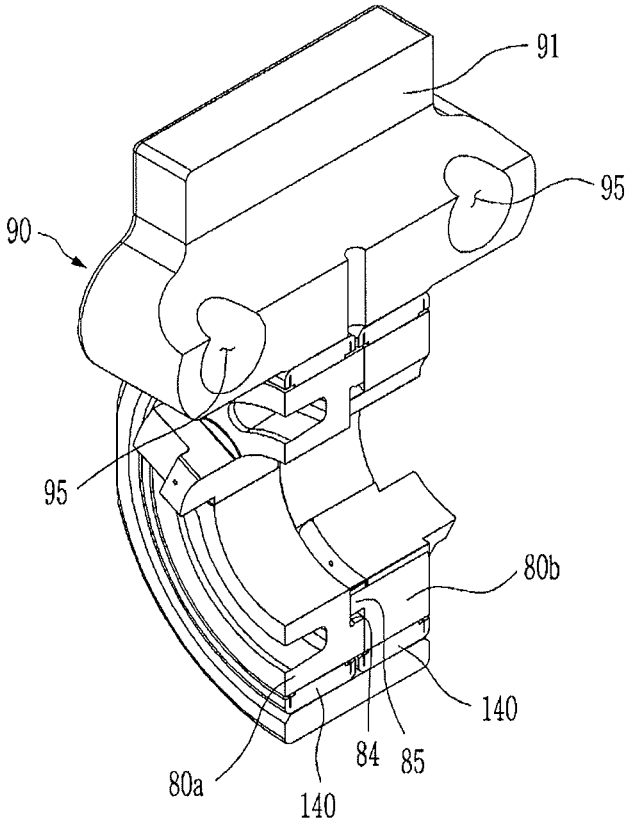
FIG. 14 is a cross-sectional view of and an internal bracket of a continuous variable valve duration apparatus according to an exemplary embodiment of the present invention.

FIG. 13 is an exploded perspective view of and an internal bracket of a continuous variable valve duration apparatus according to an exemplary embodiment of the present invention, and FIG. 14 is a cross-sectional view of and an internal bracket of a continuous variable valve duration apparatus according to an exemplary embodiment of the present invention.

Referring to FIG. 1 to FIG. 14, a first sliding hole 86 and a second sliding hole 88 are formed on the internal bracket 80 respectively and a cam slot 74 is formed at the cam device 70.

The continuous variable valve duration apparatus further includes a slider pin 60 connected to the camshaft 30 and rotatably inserted into the first sliding hole 86 and a roller cam 82 slidably inserted into the cam slot 74 and rotatably inserted into the second sliding hole 88.

The roller cam 82 includes a roller cam body 82*a* slidably inserted into the cam slot 74 and a roller cam head 82*b* rotatably inserted into the second sliding hole 88.

A protrusion 82*c* is formed at the roller cam 82 for preventing the roller cam 82 from being separated from the internal bracket 80 along the longitudinal direction of the camshaft 30.

The slider pin 60 includes a pin body 62 slidably inserted into the camshaft 30 and a pin head 64 rotatably inserted into the first sliding hole 86. The pin body 62 and the pin head 64 may be formed integrally.

A camshaft hole 34 is formed at the camshaft 30, the pin body 62 of the slider pin 60 is slidably inserted into the camshaft hole 34, and the pin head 64 is rotatably inserted into the first sliding hole 86.

A camshaft oil hole 32 is formed within the camshaft 30 along a longitudinal direction thereof, a body oil hole 66 communicating with the camshaft oil hole 32 is formed at the pin body 62 of the slider pin 60 and an oil groove 68 communicating with the body oil hole 66 is formed at the pin head 64 of the slider pin 60.

Thus, lubricant supplied to the camshaft oil hole 32 may be supplied to the internal bracket 80 through the body oil hole 66, the communication hole 69, and the oil groove 68.

The cam device 70 includes a first cam portion 70*a* and a second cam portion 70*b* which are disposed corresponding to a cylinder and a neighboring cylinder respectively. For example, the first cylinder 201 with the neighboring second cylinder 202 and the internal bracket 80 includes a first internal bracket 80*a* and a second internal bracket 80*b* transmitting rotation of the camshaft 30 to the first cam portion 70*a* and the second cam portion 70*b* respectively.

The continuous variable valve duration apparatus further includes a bearing 140 disposed within the wheel housing 90 for supporting the first internal bracket 80*a* and the second internal bracket 80*b*.

The bearing 140 may be a needle bearing, the first and the second internal brackets 80*a* and 80*b* are disposed within a wheel housing 90, and the bearing 140 may rotatably support the first and the second internal brackets 80*a* and 80*b*.

Since the first and the second internal brackets 80*a* and 80*b* are disposed within a wheel housing 90, element numbers may be reduced so that productivity and manufacturing economy may be enhanced.

The first internal bracket 80*a* and the second internal bracket 80*b* within the wheel housing 90 may be connected each other. For example, a first internal bracket connecting portion 84 and a second internal bracket connecting portion 85 are formed at the first internal bracket 80*a* and the second internal bracket 80*b* respectively, and the first internal bracket connecting portion 84 and the second internal bracket connecting portion 85 are connected to each other.

In the drawing, the first internal bracket connecting portion 84 and the second internal bracket connecting portion 85 are formed as convex and concave, however the present invention is not limited thereto.

In the case that the first internal bracket 80*a* and the second internal bracket 80*b* are connected, looseness or vibration due to manufacturing tolerances of the bearing, the internal bracket, the wheel housing and so on may be reduced.

Two cams 71 and 72 may be formed on the first and the second cam portions 70*a* and 70*b* as a pair and a cam cap connecting portion 76 is formed between the paired cams 71 and 72 of each of the first and second cam portions 70*a* and 70*b*.

The cam 71 and 72 rotate and open the valve 200.

The continuously variable valve duration apparatus further includes a cam cap 40 on which a cam supporting portion 46 configured to rotatably support the cam cap connecting portion 76 is formed on the cam cap 40.

A stopper 106 for limiting rotation of the control shaft 108 is formed at the control portion 100.

As shown in FIG. 9, the stopper 106 protrudes to the first journal 102 and a journal bracket protrusion 111 is formed at the journal bracket 110 wherein the rotation of the control shaft 108 may be limited.

The guide bracket 134 is connected to the cam cap 40 rotatably supporting the cam connecting portion 76 of the cam device 70.

The journal bracket 110 is connected to the cam cap 40, so that an assemble process and maintenance of a vehicle may be easily performed.

Figure 15:
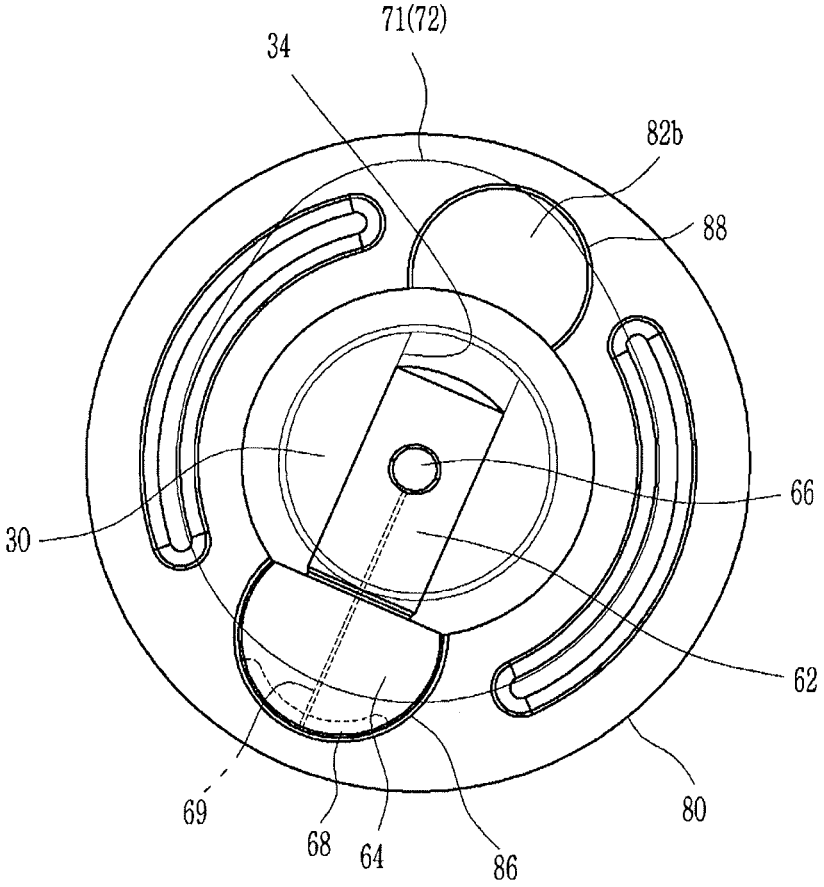
FIG. 15, FIG. 16, and FIG. 17 are drawings showing operations of a continuous variable valve duration apparatus according to an exemplary embodiment of the present invention.
Figure 16:
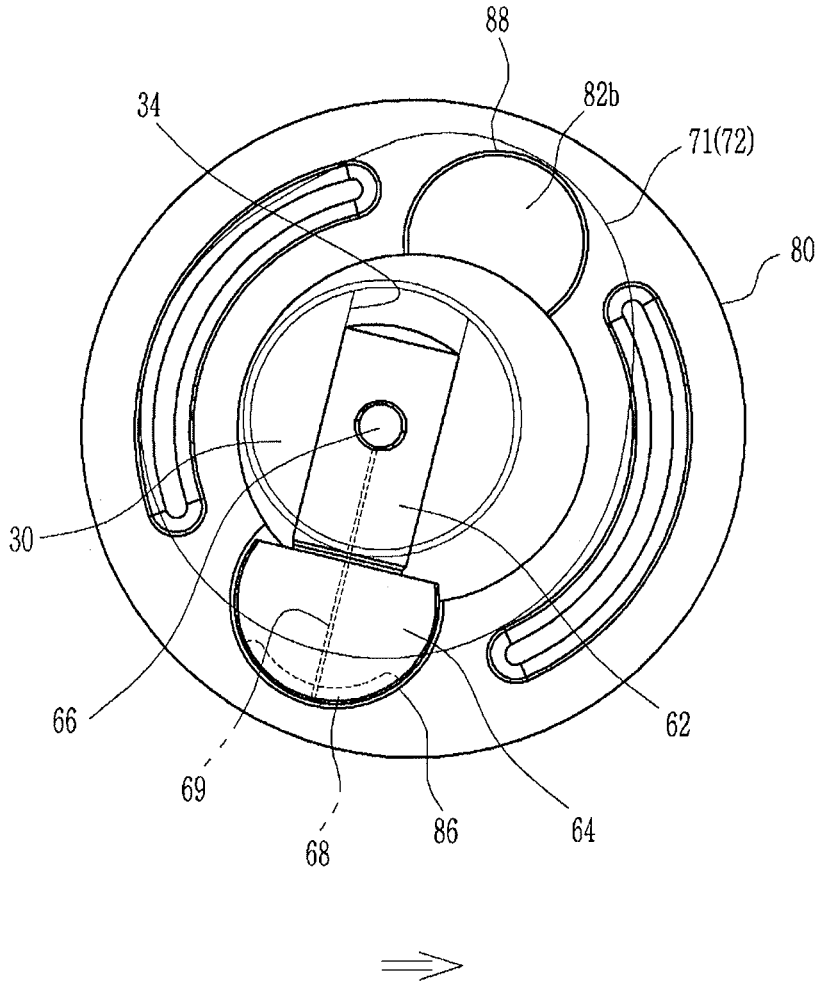
Figure 17:
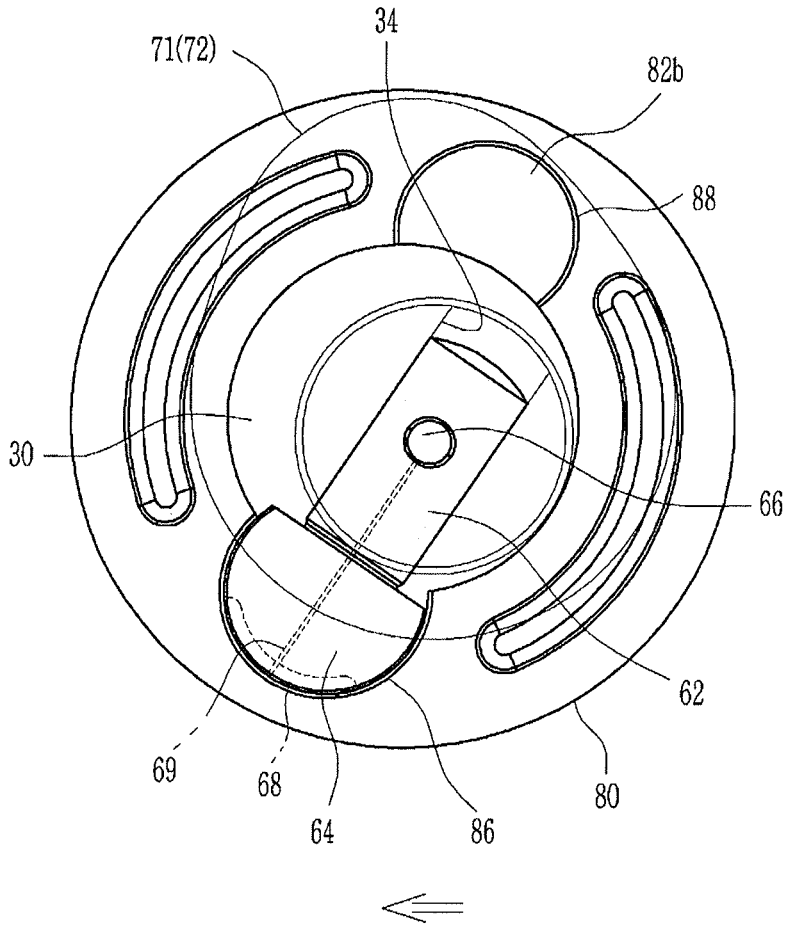

FIG. 15, FIG. 16, and FIG. 17 are drawings showing operations of a continuous variable valve duration apparatus according to an exemplary embodiment of the present invention.

As shown in FIG. 15, when rotation centers of the camshaft 30 and the cam device 70 are coincident, the cams 71 and 72 rotate with the same phase angle of the camshaft 30.

According to an engine operation states, an ECU (engine control device or electric control unit) transmits control signals to the control portion 100, and then the control motor 112 rotates the control shaft 108.

As shown in FIG. 16 and FIG. 17, a relative position of the wheel housing 90 with respect to the camshaft 30 is changed due to the rotation of the control shaft 108.

When the relative position of the wheel housing 90 with respect to the camshaft 30 is changed, the relative rotation speed of the cams 71 and 72 with respect to the rotation speed of the camshaft 30 is changed.

While the slider pin 60 is rotated with the camshaft 30, the pin body 62 is slidable within the camshaft hole 34, the pin head 64 is rotatable within the first sliding hole 86, and the roller cam 82 is rotatably within the second sliding hole 88 and slidable within the cam slot 74. Thus, the relative rotation speed of the cams 71 and 72 with respect to the rotation speed of the camshaft 30 is changed.

Figure 18:
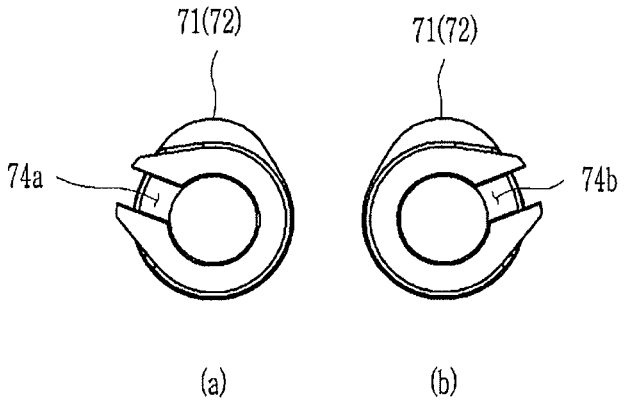
FIG. 18 is a drawing showing a cam slot of a continuous variable valve duration apparatus according to an exemplary embodiment of the present invention.
Figure 19:
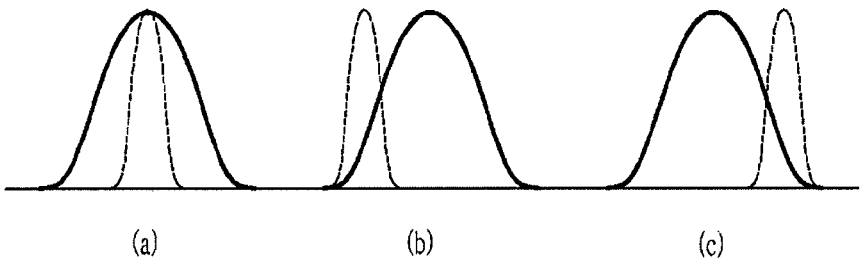
FIG. 19 is a graph showing valve profile of a continuous variable valve duration apparatus according to an exemplary embodiment of the present invention.

FIG. 18 is a drawing showing a cam slot of a continuous variable valve duration apparatus according to an exemplary embodiment of the present invention, and FIG. 19 is a graph showing valve profile of a continuous variable valve duration apparatus according to an exemplary embodiment of the present invention.

As shown in FIG. 18, the cam slot 74 may be formed more retarded than a position of the cam 71 or 72 (referring to (74*a*) of FIG. 18), the cam slot 74 may be formed more advanced than a position of the cam 71 or 72 (referring to (74*b*) of FIG. 18), or the cam slot 74 may be formed with the same phase of the cam 71 or 72. With the above schemes, various valve profiles may be achieved.

Although maximum lift of the valve 200 is constant, rotation speed of the cam 71 and 72 with respect to the rotation speed of the camshaft 30 is changed according to relative positions of the slider housing 90 so that closing and opening time of the valve 200 is changed. That is, duration of the valve 200 is changed.

According to the relative position of the cam slot 74, mounting angle of the valve 200 and so on, opening and closing time of the valve may be simultaneously changed as shown in (a) of FIG. 19.

While opening time of the valve 200 is constant, closing time of the valve 200 may be retarded or advanced as shown (b) of FIG. 19.

While closing time of the valve 200 is constant, opening time of the valve 200 may be retarded or advanced as shown (c) of FIG. 19.

As described above, a continuous variable valve duration apparatus according to an exemplary embodiment of the present invention may achieve various valve duration with a simple construction.

The continuous variable valve duration apparatus according to an exemplary embodiment of the present invention may be reduced in size and thus an entire height of a valve train may be reduced.

Since the continuous variable valve duration apparatus may be applied to a conventional engine without excessive modification, thus productivity may be enhanced and production cost may be reduced.

Since the body oil hole 66 and the oil groove 68 are formed at the slider pin 60, lubricant may be smoothly supplied to rotating elements including the internal brackets and so on.

Since shape of the guide groove 91 may be simple, and thus manufacturing process may be simple and manufacturing cost may be reduced.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus including:

a camshaft;

a cam device on which a cam is formed, of which the camshaft is configured to be inserted thereto and of which a relative phase angle with respect to the camshaft is variable;

an internal bracket transmitting a rotation of the camshaft to the cam device;

a wheel housing in which the internal bracket is rotatably inserted, on which a guide groove parallel to the camshaft is formed, and on which a guide hole vertical to the camshaft is formed;

a guide portion including a guide shaft inserted into the guide hole for guiding a movement of the wheel housing; and a control portion including a control shaft disposed parallel to the camshaft and inserted into the guide groove, and the control portion selectively rotating the control shaft for a relative position of the wheel housing with respect to the camshaft to be changed, wherein a first sliding hole and a second sliding hole are formed at the internal bracket respectively, and a cam slot is formed at the cam device, and wherein the continuous variable valve duration apparatus further includes:

a slider pin connected to the camshaft and rotatably inserted into the first sliding hole; and a roller cam slidably inserted into the cam slot and rotatably inserted into the second sliding hole.

2. The continuous variable valve duration apparatus of claim 1, wherein the guide portion further includes a guide bracket supporting the guide shaft.

3. The continuous variable valve duration apparatus of claim 1, wherein the roller cam includes:

a roller cam body slidably inserted into the cam slot; and a cam head rotatably inserted into the second sliding hole.

4. The continuous variable valve duration apparatus of claim 3, wherein a protrusion for preventing the roller cam from being separated is formed at the roller cam.

5. The continuous variable valve duration apparatus of claim 1, wherein the slider pin includes:

a pin body slidably inserted into the camshaft; and a pin head rotatably inserted into the first sliding hole.

6. The continuous variable valve duration apparatus of claim 5, wherein the pin body and the pin head are integrally formed.

7. The continuous variable valve duration apparatus of claim 5, wherein a camshaft oil hole is formed within the camshaft along a longitudinal direction thereof;

a body oil hole communicating with the camshaft oil hole is formed at the pin body of the slider pin; and an oil groove communicating with the body oil hole is formed at the pin head of the slider pin.

8. The continuous variable valve duration apparatus of claim 1, wherein the cam device includes a first cam portion and a second cam portion which are disposed corresponding to a cylinder and an adjacent cylinder respectively; and the internal bracket includes a first internal bracket and a second internal bracket configured for transmitting a rotation of the camshaft to the first cam portion and the second cam portion respectively.

9. The continuous variable valve duration apparatus of claim 8, further including a bearing disposed within the wheel housing for supporting the first internal bracket and the second internal bracket.

10. The continuous variable valve duration apparatus of claim 8, wherein the first internal bracket and the second internal bracket are connected to each other.

11. The continuous variable valve duration apparatus of claim 8, wherein two cams are formed at the first cam portion and the second cam portion; and a cam connecting portion is formed between the cams; and wherein the continuous variable valve duration apparatus further includes a cam cap on which a cam supporting portion configured for supporting the cam connecting portion is formed.

12. The continuous variable valve duration apparatus of claim 1, wherein the control portion includes:

a control motor;

a first journal connected to the control motor and on which a first journal hole is eccentrically formed; and a second journal on which a second journal hole is eccentrically formed, and wherein the control shaft is configured to be inserted into the first journal hole and the second journal hole.

13. The continuous variable valve duration apparatus of claim 12, further including a journal bracket rotatably supporting the first journal and the second journal.

14. The continuous variable valve duration apparatus of claim 13, wherein a stopper is formed at the control portion for limiting a rotation of the control shaft.

15. The continuous variable valve duration apparatus of claim 1, further including:

a cam cap rotatably supporting the cam device; and a guide bracket supporting the guide shaft and connected to the cam cap.

16. The continuous variable valve duration apparatus of claim 15, further including:

a first journal on which a first journal hole where the control shaft is configured to be inserted into is eccentrically formed;

a second journal on which a second journal hole where the control shaft is configured to be inserted into is eccentrically formed; and a journal bracket rotatably supporting the first journal and the second journal.

17. The continuous variable valve duration apparatus of claim 16, wherein the journal bracket is mounted to the cam cap.

18. An engine provided with the continuous variable valve duration apparatus of claim 1.

* * * * *